United States Patent [19]

Stühmeier et al.

[11] Patent Number: 4,525,935

[45] Date of Patent: Jul. 2, 1985

[54] METHOD FOR DEWATERING ITEMS OF WASHED LAUNDRY

[75] Inventors: Günter Stühmeier, Löhne; Karl Holzinger, Bad Oeynhausen, both of Fed. Rep. of Germany

[73] Assignee: Herbert Kannegiesser GmbH & Co., Vlotho, Fed. Rep. of Germany

[21] Appl. No.: 440,476

[22] Filed: Nov. 9, 1982

Related U.S. Application Data

[63] Continuation-in-part of Ser. No. 401,280, Jul. 23, 1982, abandoned.

[30] Foreign Application Priority Data

Aug. 6, 1981 [DE] Fed. Rep. of Germany ..... 3131093

[51] Int. Cl.[3] ..... F26B 5/14

[52] U.S. Cl. ..... 34/14; 34/17; 34/18; 34/70

[58] Field of Search ..... 34/70, 69, 71, 145, 34/14, 17, 18

[56] References Cited

U.S. PATENT DOCUMENTS

| | | | |
|---|---|---|---|
| 1,726,373 | 8/1929 | Voightlander | 34/70 |
| 1,937,860 | 12/1933 | Watkins | 34/70 |
| 4,128,947 | 12/1978 | Jackson | 34/70 |

*Primary Examiner*—Larry I. Schwartz

*Attorney, Agent, or Firm*—Sughrue, Mion, Zinn, Macpeak and Seas

[57] ABSTRACT

Wet laundry 10 in a vessel 12 supported on a drainage plate 14 is dewatered by a combination of mechanical pressure applied by a platen 33 and air flow through the platen and laundry. The platen is initially brought down upon the laundry by a cylinder 42 to compress it and squeeze out about half of the water, and drying air is simultaneously forced through the vessel from top to bottom via the platen and plate to remove additional moisture. The platen pressure may be reduced to enhance the air flow.

9 Claims, 8 Drawing Figures

METHOD FOR DEWATERING ITEMS OF WASHED LAUNDRY

BACKGROUND OF THE INVENTION

This application is a continuation-in-part of application Ser. No. 401,280 filed July 23, 1982, and now abandoned.

The invention relates to a process for dewatering items of washed laundry, in which process the items of laundry are introduced into a cylindrical vessel with a lower counterpressure-plate, through which air and water can pass, and, after the upper vessel-lid of this vessel has been closed or dewatered by means of downward-flowing air (flow-dewatering).

In a known process of the abovementioned type, and in an appliance for carrying out this process (U.S. Pat. No. 4,128,947), the flow-dewatering operation is effected by means of hot air, at 135° to 190° C. The air flows, at a pressure of approximately 0.7 bar, through the items of laundry. In German Auslegeschrift No. 2,940,217, the flow-dewatering operation is effected by means of the high-pressure saturated steam which is customarily used in laundries, at pressures ranging from approximately 10 to 13 bar. Immediately before being led into the cylindrical vessel, this steam is first of all led through a water separator, and then through a pressure-reducing device, thus enabling it to be led into the vessel at a pressure of 2 bar or 5 bar, according to choice. In this case, the items of laundry are consequently dewatered by means of steam at approximately 180° C., this steam having been dried and, within the course of the pressure-reduction, superheated. While, in the first case (U.S. Pat. No. 4,128,947) the degree of dewatering achieved by the flow-dewatering operation employing hot air is not indicated, the degree of dewatering or residual moisture content in the second case (German Auslegeschrift No. 2,940,217, achieved by means of steam is indicated as being approximately 35%. In the case of dewatering by means of steam, the duration of the dewatering operation is approximately 40 to 60 seconds per load. In the first case, dewatering to a residual moisture content of approximately 35% is impossible, at least within the abovementioned time, due to the low pressure (approx. 0.7 bar) at which the hot air flows through the items of laundry. Consequently, the known hot-air flow process and the appliance for carrying it out cannot be used for the economical dewatering of items of washed laundry.

In both the known forms of flow-dewatering (U.S. Pat. No. 4,128,947=hot air, German Auslegeschrift No. 2,940,217=superheated steam), the upper portion of the vessel, which is not filled with laundry, or is incompletely filled, must, after filling the dewatering vessel and closing its vessel-lid, first be filled with the flowing medium (air or, as the case may be, steam), the dewatering vessel having to be comparatively generously dimensioned with a view to the loading operation. Furthermore, the unoccupied upper space which additionally develops in the vessel, following a first, light compression of the laundry by means of a platen through which air and water can pass, must, however, also be filled with flowing medium. The platen, which levels out the top of the heap of laundry in the vessel, and which furthermore distributes the flowing medium, is represented in the first case (U.S. Pat. No. 4,128,947), but is not represented in the second case (German Auslegeschrift No. 2,940,217), although it is present in practice. In both cases, more flowing medium is consumed, for design-related reasons, than is required for the dewatering operation per se, and this leads to the waste of energy and is hence disadvantageous. Furthermore, however, the design-related requirement for the upper space in the vessel (hold-up space), not occupied by laundry, to be filled with flowing medium before starting the actual dewatering operation is time-consuming.

In both the known forms of the flow-dewatering process (U.S. Pat. No. 4,128,947, German Auslegeschrift No. 2,940,217), it is also disadvantageous that flowing agents are used which consume large amounts of energy and which, furthermore, due to their high temperatures (135° to 190° C., and 180° C., respectively), produce fine-creasing which is visible even after the process of mangling and/or ironing the items of laundry following the dewatering operation, at least when items of laundry manufactured from mixed fabrics (cotton synthetics) are being dewatered. The flowing agents used consequently lead to an inferior smoothness effect than when the items of laundry are dewatered in a customary manner, for example by means of so-called "membrane-type" dewatering presses.

Finally, a further process and appliance for flow-dewatering by means of superheated steam is known (French Pat. No. 1,003,692), in which the flow-dewatering is employed in combination with a centrifuging or spinning operation on the laundry (FIG. 1 of the French Patent). The steam is supplied to the laundry, in particular, while it is being spun. Consequently, some of the principal disadvantages, which have already been mentioned, of the other previously known processes and appliances (U.S. Pat. No. 4,128,947, German Auslegeschrift No. 2,940,217) are also present in this case, namely a flowing agent which requires large amounts of energy, and fine creasing of the items of laundry resulting from the high dewatering temperatures necessitated by the flowing agent.

Moreover, in the case of the known processes and appliances (U.S. Pat. No. 4,128,947, German Auslegeschrift No. 2,940,217, French Pat. No. 1,003,692), which are operated by means of hot air and superheated steam, as flowing agents, it is disadvantageous that it is comparatively difficult to control the residual moisture in the items of laundry, this control being, as a rule, effected as a function of time. This difficulty is attributable inter alia, to the significant evaporation process which occurs in the course of the hot-dewatering operation. Experience with one of the known processes (German Auslegeschrift No. 2,940,217) has shown, for example, that considerable differences in residual moisture can sometimes exist, both from one dewatering load to another dewatering load, as well as within a load, that is to say, from one item of laundry to another, these differences being as large as 16% within one load.

In the known appliances, it is disadvantageous, moreover, that the dewatering vessels can be emptied, after the dewatering operation, only by measures which are time-consuming. Thus, for example, in one case (German Auslegeschrift No. 2,940,217), the vessel cannot be emptied, by swivelling it, until the vessel-lid has been removed.

SUMMARY OF THE INVENTION

The object underlying the invention is consequently to design a process, of the type initially mentioned, in such a manner that the flow-dewatering operation can be carried out with a considerably lower expenditure of energy, that the items of laundry have, at worst, only slight fine creasing after being mangled and/or ironed, and that the residual moisture content of the items of laundry is subject to less marked fluctuations than in the case of the known processes. The apparatus for carrying out the process is designed to enable the cylindrical vessel to be emptied, after the dewatering operation, in a time-saving and economical manner.

In the process, according to the invention, the air-flow-dewatering operation is restricted to that portion of the total dewatering work to be performed, which cannot be normally carried out by mechanical means. Since this is the smaller portion of the dewatering work to be performed, this restriction leads straight away to a saving of energy which is considerable per se. This saving of energy can be further improved, to a considerable extent, if the flow-dewatering operation is carried out merely with normal compressed air, or with air at room (ambient) temperature. Tests have shown that a saving of approximately 50% is possible.

The process according to the invention is therefore a combination of flow-dewatering and dewatering by pressing the items of laundry, the latter operation being known in principle.

When the flow-dewatering operation is carried out by means of normal compressed air, or air at room (ambient) temperature, the fine creasing of items of laundry, particularly items manufactured from mixed fabrics, is avoided, because this temperature is considerably below the temperature at which the synthetic fibres of the mixed-fabric laundry items are rendered plastic and are permanently deformed if, at the same time, pressure is applied to them.

If the flow-dewatering operation is carried out by means of hot air, at 80° to 130° C., but, in particular, at 110° C., that is to say, at a temperature which lies immediately below the limit at which most synthetics become plastic, the energy-consuming heating of the air then, admittedly, results in the loss of the considerable saving in energy mentioned aboe, but the saving remains significant due to the fact that the flow-dewatering operation remains restricted to the smaller portion of the total dewatering work to be performed. However, dewatering by means of hot air, at the abovementioned temperature, is appropriate, or advantageous, only in the case of some special items of laundry. As a rule, normal compressed air, or air at room (ambient) temperature can be used for dewatering items of laundry consisting of either cotton or mixed fabrics.

Moreover, carrying out the flow-dewatering process by means of normal compressed air, or air at room (ambient) temperature, further leads to the result that significant differences in residual moisture content are avoided.

The use of disinfected air enables the process to be applied even in those cases in which regulations to this effect must be complied with, or in which the disinfection resulting simply from the use of hot air at over 100° C. is inadequate.

In the drying process for pieces of laundry in accordance with the invention one can in the second phase, that is during the drying process, maintain the mechanical pressure (produced through a stamping press or press plate) at its maximum. But, alternatively, it is also possible to reduce the mechanical pressure during the drying by air current, specifically to a value which is below the maximum pressure or to the point where the pressure is exerted only through the weight of the press plate resting freely on the pieces of laundry. A further alternative is to remove all mechanical pressure from the pieces of laundry during this phase, for instance by raising the press plate.

No additional pressure ram is required for the vessel-lid, due to the fact that the vessel-lid is designed in the form of a vertically movable pressure-ram which can be guided into, and out of, the vessel, and which can be impressed (pressed), by mechanical means, directly onto the laundry which is present in the vessel. Moreover, this design ensures, in particular, that, due to the absence of an upper hold-up space when the flowing agent is introduced, the flowing agent need be introduced into the vessel only to the extent to which it is actually needed for the flow-dewatering operation, as a result of which there is a saving of energy even when normal compressed air, or air at room (ambient) temperature is used, and, moreover, there is also a saving of time. This design of the appliance can consequently be used, with advantage, both in appliances in which air is employed for flow-dewatering, and in appliances in which the flow-dewatering is effected by means of steam (German Auslegeschrift No. 2,940,217).

DETAILED DESCRIPTION OF THE PREFERRED EMBODIMENTS

Figure 1:
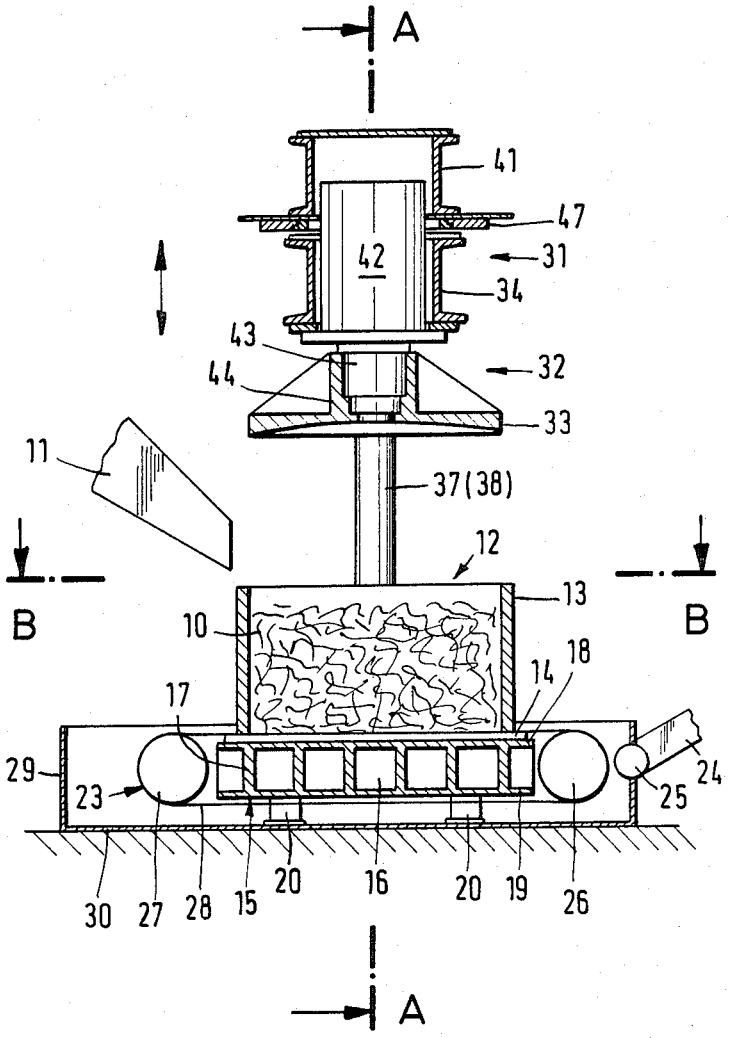
FIG. 1 shows the apparatus, sectioned along a vertical longitudinal plane.

The apparatus represented in the drawings is intended for the dewatering of washed laundry 10, following its rinsing, and is suitable for this purpose. A batch of this wet laundry, coming from the washing machine or the rinsing machine, is conveyed, via a chute 11, which is represented diagrammatically, into a vessel 12, customarily with rinsing water. After conveying in the batch of laundry 10, the chute is moved aside.

The vessel 12 comprises a vessel-shell 13, which is cylindrical in the present case and is closed at the bottom by means of a base structure. This structure comprises a counterpressure-plate 14, forming the actual bottom of the vessel 12. In order to receive considerable pressure-forces without breaking down, this comparatively thin counterpressure-plate 14 is mounted on a sub-structure which can be loaded, namely a base plate 15. This baseplate is designed as a supporting structure of the hollow-box type, namely with longitudinal walls 16 and transverse walls 17, serving as stiffening members between upper and lower supporting plates 18, 19. The baseplate 15, designed in this manner, is mounted on supporting feet 20, located at the sides.

The counterpressure-plate 14 is designed in such a manner that the water issuing from the laundry 10 can escape in this region, namely from the vessel 12, at the bottom. For this purpose, the counterpressure-plate 14 is designed with channels 21, in the form of grooves which are open in the upward direction, running at right angles to the conveying direction of the transport belt 23 which is described below. The water, which is running off, is collected in these channels and conveyed away laterally.

In the present illustrative embodiment, the upper run 22 of a transport belt 23 is located on the upper surface of the counterpressure-plate 14, which is designed as described above. This transport belt enables the batch of laundry 10 to be transported away following the conclusion of the dewatering operation, namely to an outgoing transport belt 24, the drive/reversing roller 25 of this belt being located in proximity to a reversing roller 26 of the transport belt 23. A second reversing roller 27 is located on the opposite side, with respect to the baseplate 15. One of the two reversing rollers 26, 27 is driven. The lower run 28 of the transport belt 23 extends, at the underside of the baseplate 15, between the supporting feet 20.

The vessel 12, designed in this manner, is mounted inside a container 29 for collecting water, the supporting feet 20 standing on the bottom 30 of this container.

A pressure device 31 is located above the vessel 12. This device essentially comprises a pressure ram 32 with a platen 33. The latter is lowered, under pressure, onto the laundry 10 inside the vessel 12. The pressure ram 32 is fitted for this purpose to a pressure yoke 34 movable up and down. This yoke, in turn, is mounted by means of lateral sliding guides 35, 36 at, or on, vertical guide columns 37, 38. The design of the exterior of the pressure ram 32 and of the platen 33 is such that they can be guided into, and out of, the vessel 12, in a manner producing an airtight seal, and bear against the cylindrical vessel-shell 13 of the vessel.

Figure 2:
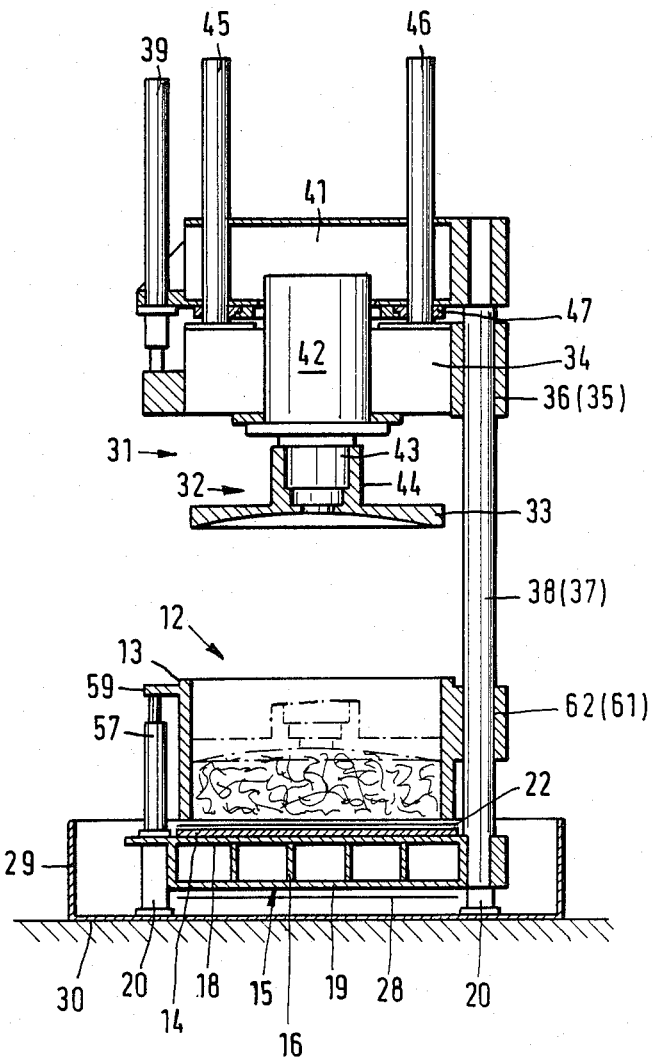
FIG. 2 shows a section according to the sectioning plane A—A in FIG. 1, displaced through 90° relative to FIG. 1.
Figure 3:
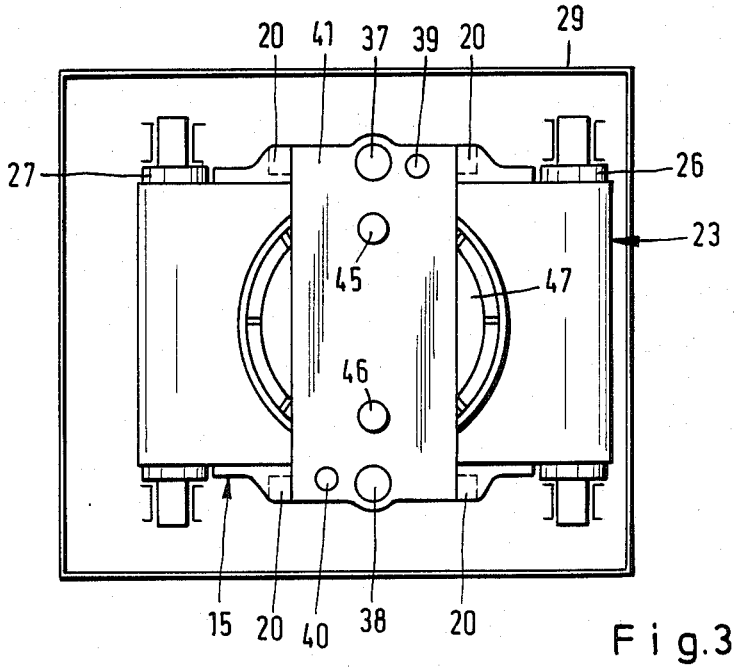
FIG. 3 shows the apparatus in horizontal projection, or plan, looking down onto FIG. 1.
Figure 4:
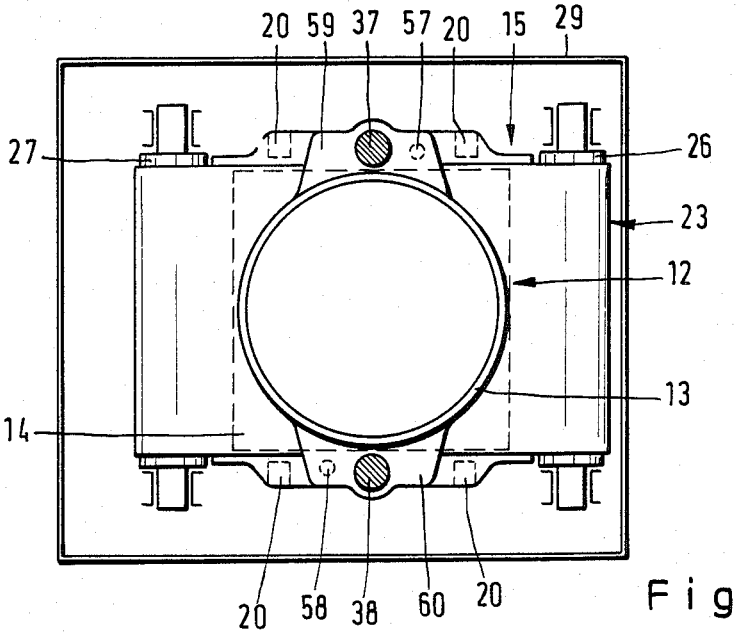
FIG. 4 shows a horizontal section according to the sectioning plane B—B in FIG. 1.

The upper, starting position of the pressure device 31 is shown in FIGS. 1 and 2, this position being remote from the vessel 12. In order to dewater the laundry 10, by pressing it inside the vessel 12, the pressure yoke 34, with the pressure ram 32 and the platen 33, is moved downwards, into a lower, working position (not represented), facing the vessel 12. For this purpose, (two) long-stroke transport cylinders, 39 and 40, act on the pressure yoke 34. These transport cylinders enable the pressure yoke 34 to be moved upwards and downwards on the guide columns 37 and 38.

The transport cylinders 39 and 40 are mounted on an upper, fixed supporting member, namely on a cross-member 41. This cross-member connects the upper ends of the guide columns 37 and 38, one to the other. The guide columns 37, 38 are attached to the cross-member 41 in such a manner that considerable loads can be transmitted.

The lower ends of the guide columns 37, 38 are attached to the baseplate 15, which can likewise be loaded, in the same manner, so that the baseplate 15, the guide columns 37, 38, and the cross-member 41 form a supporting framework which can be loaded, in which the pressure device 31 is supported.

In order to transmit the required pressing force to the pressure ram 32 and the platen 33, a separate pressing cylinder 42 is provided, which, in this embodiment, is located centrally with respect to the platen 33. The pressing cylinder 42 is connected to the pressure yoke 34 and can accordingly be moved upwards and downwards, as a part of the pressure device 31. A piston rod 43 is connected to an upper hub 44 of the platen 33. The pressing cylinder 42, with a comparatively short stroke, comes into action merely in the lower working position of the pressure device 31, in order to transmit the high pressing pressure onto the platen 33.

Figure 7:
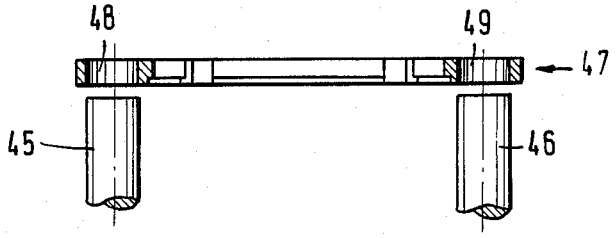
FIG. 7 shows a radial section through a detail of a locking device, likewise on an enlarged scale.
Figure 8:
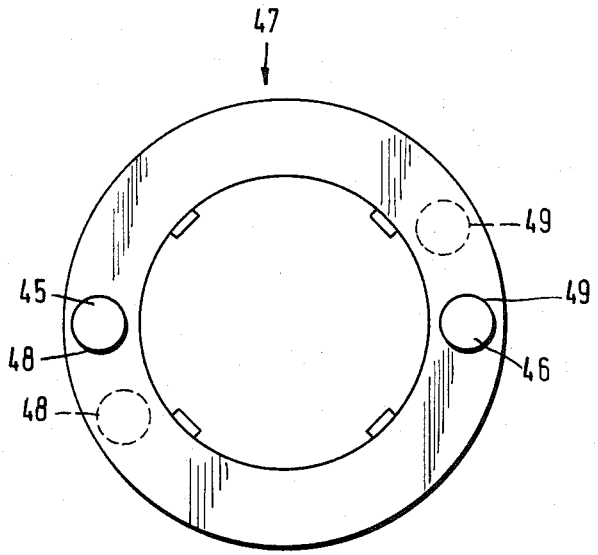
FIG. 8 shows a representation, in horizontal projection, or plan, of the detail according to FIG. 7.

In this lower, working position, the reaction forces from the pressure device 31 are transmitted to the upper cross-member 41 via a support. For this purpose, (two) supporting rams 45, 46 are fitted to the pressure yoke 34. These supporting rams 45, 46 can be moved upwards and downwards, with the pressure yoke 34, in such a manner that, in the (lower) working position, their upper, free ends are beneath a locking plate 47, which is located on the underside of the cross-member 41. The ring-shaped locking plate 47 can be moved between an unlocking position (FIGS. 2 and 7) and a locking position (position indicated by a broken line in FIG. 8), that is to say, it can be rotated through approximately 15°. The locking plate 47 is provided with guide-bores 48, 49, which, in the unlocked position, correspond with the supporting rams 45, 46. In the upper position of the pressure device 31, and during the upwards and downwards movement, these supporting rams pass through the guide-bores 48, 49. In the working position, the supporting rams 45, 46 are located directly beneath the locking plate 47, which has been rotated, as already stated, so that the supporting rams 45, 46 can bear against the locking plate 47, as a result of which the reaction forces can be transmitted onto the cross-member 41.

Figure 5:
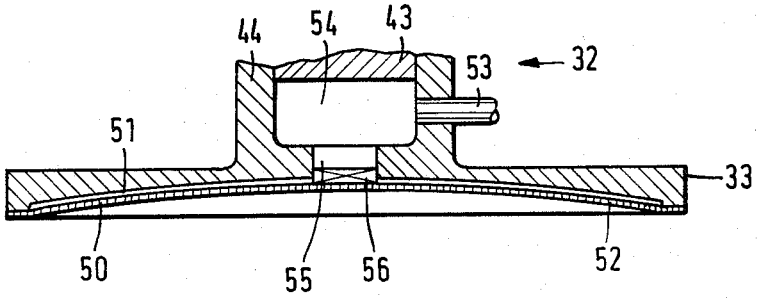
FIG. 5 shows a detail of the apparatus, namely a platen, in vertical section, on an enlarged scale.
Figure 6:
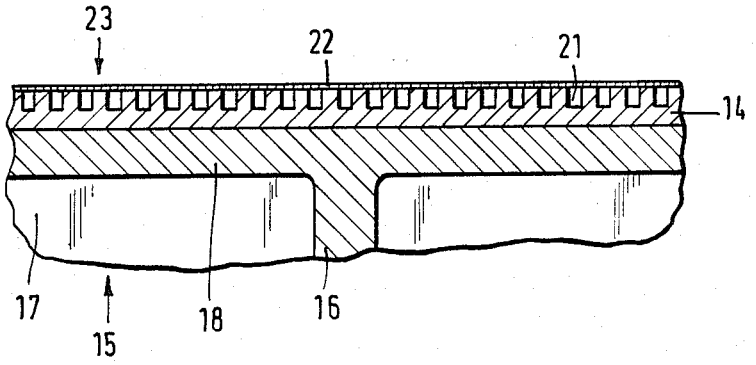
FIG. 6 shows a detail in the region of a vessel, namely a counterpressure-plate with support, in section according to the sectioning plane A—A in FIG. 1, on a scale which is again enlarged.

The platen 33 is designed in a special manner (FIG. 5). That (lower) side of the platen 33, which faces the laundry 10, namely the pressure surface 50, is domed to render it concave, so that the laundry 10, in the region of this plate, is pressed away from the wall of the vessel as it starts to be compressed. The platen 33, designed in this manner, serves simultaneously to supply the flowing medium (air) and to distribute it over the laundry. For this purpose, a compressed-air line 53 is connected to the platen 33, specifically at its hub 44. A compressed-air space 54 is formed beneath the piston rod 43 of the pressing cylinder 42, this space being connected, via a through-passage 55, to the underside of the platen 33, and consequently to the radial and transversely-aligned distribution channels 51, which are located there, and are open towards towards the underside. A perforated plate 52, which is likewise shaped in a concave manner, is located beneath the underside of the platen 33. The members, described above, uniformly distribute the flowing medium in the vessel 12, and thereby direct it through the laundry 10. A non-return valve 56 is located in the region of the through-passage 55, this valve preventing reverse-flow of the flowing medium (air), or preventing water from flowing back, especially during the mechanical pressing phase.

As already stated, the vessel 12 or, as the case may be, the vessel-shell 13, can be lifted from the counterpressure-plate 14. For this purpose, two lifting cylinders 57, 58 are supported on the baseplate 15, on the one hand, and are connected, on the other hand, to projections 59, 60 on the vessel-shell 13. By extending the piston rods of the lifting cylinders 57, 58, the vessel-shell 13 is raised from the counterpressure-plate 14, thus enabling the dewatered batch of laundry 10 to be transported away by means of the transport belt 23. For this purpose, the vessel-shell 13 is connected to the guide columns 37, 38, in the region of the projections 59, 60, via sliding bearings 61, 62.

The apparatus, designed in the manner described above, functions as follows:

After introducing a batch of wet laundry 10 into the vessel 12, the vessel-shell 13 being positioned on the counterpressure-plate 14, the pressure device 31, with the pressure yoke 34, is moved into a lower, working position, and locked, in this position, in the manner described. In this position, the platen 33 is located approximately 20 to 30 mm above the upper edge of the vessel-shell 13.

A load is now applied to the platen 33, by the pressing cylinder 42. The platen 33 is moved downwards, at a high speed, until a predetermined pressure is reached in the vessel 12, or in the hydraulic system of the pressing cylinder 42, this pressure being deployed by the counterpressure of the laundry 10, and amounting preferably, to approximately 50% of the maximum dewatering pressure. As soon as this occurs, the downward movement of the platen 33 is switched over to creeping speed, until a predetermined maximum dewatering pressure of approximately 25.0 kp/cm$^2$ in connection with cotton fabrics and of approximately 10.0 kp/cm$^2$ in connection with mixed fabrics (cotton and synthetics) is reached. Thereafter, the platen executes a further downward movement, maintaining the predetermined maximum dewatering pressure in the meanwhile, until a predetermined dewatering time has elapsed, provided that the laundry can still be compressed.

The medium for the flow-dewatering operation (air) is brought into action at a point in time which is staggered with respect to the mechanical dewatering operation, and in particular, in an advantageous manner, after the predetermined maximum dewatering pressure has been reached by the platen 33, that is to say, following the conclusion of the downward movement at the creeping speed. The flow-dewatering operation is carried out until the predetermined dewatering time has expired, maintaining the maximum dewatering pressure in the meanwhile. The laundry 10 thus continues, as far as possible, to be mechanically pressed, even during the flow-dewatering operation. Mechanical dewatering and flow-dewatering take place in the same direction. The initial mechanical dewatering operation is carried out until the residual moisture content reaches 50 to 45%. The flow-dewatering operation, which follows thereafter, is carried out until the residual moisture content reaches 40 to 30%, during which operation, if appropriate, mechanical dewatering is also continued, at least at first.

Particularly favorable drying results, especially with regard to the duration of the drying process, are surprisingly achieved when, after the completion of the mechanical reduction of the water content, in other words during the subsequent air current drying, the press plate 33 is made to bear on the laundry with a significant reduction in pressure compared to the maximum pressure exerted during the mechanical phase of reducing the water content. It is appropriate, for example, for the press plate merely to rest under its own weight on the laundry during the air current drying phase. Alternatively, the press plate 33 can be slightly raised after the completion of the mechanical phase such that there is no pressure on the pieces of laundry, whereby the air current drying is accomplished without subjecting the laundry to any mechanical pressure.

Reducing or eliminating mechanical pressure during the air drying phase has the obvious result that the air current flows more easily through the pieces of laundry and is able to dry them more quickly. During such reduced or no pressure drying with hot air of about 100 degrees C., for example, the time saved amounts to about 10%.

After completion of the combined dewatering operation, the platen 33 initially remains in its lower limiting position. The vessel-shell 13 is lifted a little (approximately 20 to 30 mm), by the lifting cylinders 57, 58, in order to detach the bale of laundry (laundry 10 following dewatering) from the vessel-shell 13.

Thereafter, the pressure device 31 is, first of all, unlocked by turning the locking plate 47 backwards into the starting position. The pressure yoke 34 is now moved, with the members assigned to it, into the upper, starting position. Immediately afterwards, the piston rod 43 of the pressing cylinder 42 is retracted, by movement at high speed. Only after this movement, does a further lifting movement of the vessel-shell 13 take place, under the action of the lifting cylinders 57, 58, into the upper limiting position (approximately 300 mm total lift), as a result of which the bale of laundry, resting on the transport belt 23, can now be transported away.

It is particularly advantageous to dewater laundry composed of mixed fabrics (cotton and synthetics) by means of normal compressed air, that is to say air which has not been heated, at 4.0 bar, and to dewater cotton laundry by means of normal compressed air at 6.0 bar. However, it is also possible to use pressures of up to 10.0 bar, at least in the case of laundry manufactured from cotton. However, laundry manufactured from mixed fabrics is always subjected to a lower pressure than cotton laundry, due to the fact that it is more delicate. The greatest saving of energy occurs on using normal compressed air at 4.0 to 6.0 bar.

Normal compressed air, or air at room (ambient) temperature, is, in the present case, compressed air, which has been produced in the customary manner, and which has been filtered, in the customary manner, in particular to render it oil-free before it is supplied to the appliance.

It can be recognised that the process according to the invention and the appliance according to the invention can be used, with advantage, not only for dewatering items of washed laundry, but also for dewatering other textiles.

What is claimed is:

1. A process for dewatering batches of washed laundry, comprising the steps of:

(a) loading a batch of washed and wet laundry into an open-ended cylindrical container (12) disposed on a fluid permeable support plate (14), (b) lowering a rigid circular platen (33) dimensioned to fit closely within said container into said container at a relatively high speed until 50% of a maximum mechanical pressure on the laundry is reached to mechanically compress the laundry batch and squeeze water out through the support plate, (c) continuing to lower the platen at a relatively slower, creep speed into the container to further compress the laundry batch and squeeze additional water out through the support plate until said maximum pressure is reached, whereat a first predetermined residual moisture content is reached, (d) establishing a pressurized air flow in through the platen into the container, down through the laundry batch and out through the support plate to further dewater the laundry batch for a predetermined period of time, whereat a second, lower predetermined residual moisture content is reached, and (e) maintaining said maximum mechanical pressure of the platen on the laundry batch during step (d), to thereby initially dewater the laundry batch by mechanical pressure alone and to thereafter dewater it by both mechanical pressure and air flow.

2. Process according to claim 1, wherein the first predetermined residual moisture content is 50% to 45%, and the second predetermined residual moisture content is 40% to 30%.

3. Process according to claim 2, wherein the pressurized air is supplied at a pressure of 4 to 10 bar, in particular at 4 to 6 bar.

4. Process according to claim 3, wherein the pressurized air is at room temperature.

5. Process according to claim 3, wherein the pressurized air is at a temperature of 80° to 130° C., in particular at 110° C.

6. Process according to claim 3, wherein the pressurized air is disinfected.

7. Process according to claim 1, wherein a maximum pressure of approximately 25.0 $kp/cm^2$ is exerted on a cotton laundry batch and a maximum pressure of approximately 10.0 $kp/cm^2$ is exerted on a cotton and synthetic laundry batch.

8. A processing according to claim 1, further comprising, simultaneously with steps (b) and (c), preventing squeezed water from rising upwardly through the platen.

9. A process according to claim 8, wherein the platen is fluid imperforate.

* * * * *